US010424858B2

(12) United States Patent
Ju et al.

(10) Patent No.: US 10,424,858 B2
(45) Date of Patent: Sep. 24, 2019

(54) TERMINAL AND MANUFACTURING METHOD THEREOF

(71) Applicant: LOTES CO., LTD, Keelung (TW)

(72) Inventors: Ted Ju, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/225,150

(22) Filed: Dec. 19, 2018

(65) Prior Publication Data

US 2019/0148869 A1 May 16, 2019

Related U.S. Application Data

(63) Continuation-in-part of application No. 15/936,730, filed on Mar. 27, 2018, now abandoned.

(30) Foreign Application Priority Data

Nov. 6, 2017 (CN) ..... 2017 1 1074706

(51) Int. Cl.

| | |
|---|---|
| ***H01R 4/48*** | (2006.01) |
| ***H01R 13/24*** | (2006.01) |
| ***H01R 43/16*** | (2006.01) |
| ***H01R 12/71*** | (2011.01) |

(52) U.S. Cl.

CPC ..... *H01R 13/2457* (2013.01); *H01R 12/716* (2013.01); *H01R 13/2492* (2013.01); *H01R 43/16* (2013.01); *H01R 12/718* (2013.01)

(58) Field of Classification Search

CPC ..... H01R 23/722; H01R 12/57; H01R 13/41; H01R 13/2442

USPC ..... 439/66, 83, 733.1, 862

See application file for complete search history.

(56) References Cited

U.S. PATENT DOCUMENTS 6,315,621 B1 * 11/2001 Natori ..... H01R 13/2428 439/862
6,685,512 B2 * 2/2004 Ooya ..... G06K 7/0021 439/630
7,361,060 B2 * 4/2008 Russelburg ..... H01R 13/41 439/660

(Continued)

FOREIGN PATENT DOCUMENTS

CN 201616527 U 10/2010
CN 201708302 U 1/2011

*Primary Examiner* — Thanh Tam T Le

(74) *Attorney, Agent, or Firm* — Locke Lord LLP; Tim Tingkang Xia, Esq.

(57) ABSTRACT

A terminal and a manufacturing method thereof includes: S1: providing a metal plate sheet, and punching the metal plate sheet to form a through slot thereon, such that the metal plate sheet forms two branches on two opposite sides of the through slot; S2: cutting one end of each of the two branches, such that the ends of the two branches are separated from each other to form two contact portions respectively, and a first distance is initially provided between the two contact portions; and S3: extruding at least one of the two branches, such that the extruded branch plastically deform to increase the first distance between the two contact portions to become a second distance, preventing the two contact portions of the terminal from contacting each other and moving altogether in the process where the terminal is pressed by the chip module and elastically deforms.

10 Claims, 10 Drawing Sheets

(56) References Cited

U.S. PATENT DOCUMENTS

| | | | | |
|---|---|---|---|---|
| 7,435,100 | B2 * | 10/2008 | Chang | H01R 13/2435 439/66 |
| 7,559,811 | B1 * | 7/2009 | Polnyi | H01R 4/4809 439/591 |
| 8,192,206 | B1 * | 6/2012 | Ju | H01R 12/57 439/66 |
| 8,215,998 | B1 * | 7/2012 | Ju | H01R 12/7076 439/626 |
| 8,903,459 | B2 * | 12/2014 | Choi | H04M 1/0237 455/572 |
| 9,033,750 | B2 * | 5/2015 | Miller | H01R 13/26 439/862 |
| 9,716,330 | B2 * | 7/2017 | Pouilly | H01R 12/57 |

* cited by examiner

TERMINAL AND MANUFACTURING METHOD THEREOF

CROSS-REFERENCE TO RELATED PATENT APPLICATION

This application is a continuation-in-part of U.S. patent application Ser. No. 15/936,730, filed Mar. 27, 2018, which itself claims priority to and the benefit of, pursuant to 35 U.S.C. § 119(a), patent application Serial No. CN201711074706.2 filed in China on Nov. 6, 2017. The disclosure of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a terminal and a manufacturing method thereof, and in particular to an electrical connector terminal having an ability to transmit a high-frequency signal and having a plurality of conductive paths, and a manufacturing method thereof.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An LGA (Land Grid Array) is commonly used for an encapsulated IC (Integrated Circuit) or a chip module. To meet current transmission requirements for a high-frequency signal of a chip module, the conducting portion of LGA terminals are usually torn to form a gap, such that one conducting portion is thus divided into two contact portions, and the two contact portions can be conducted with the same conductive pad of the chip module at the same time, so as to form a plurality of conductive paths by each terminal and the chip module, thus reducing self-inductance of the terminals during a signal transmission process, and avoiding cross-talk, and thereby implementing transmission of the high-frequency signal of the chip module.

However, the gap between the two contact portions formed by tearing the same conducting portion is excessively small, and during a stressed downward elastic deformation process of the terminals, when the two contact portions on the same terminal are different in height, the higher contact portion may very likely be in contact with the lower contact portion and move altogether, such that it cannot be ensured that each terminal can have two independent contact points with the same conductive pad of the chip module. Accordingly, it cannot be ensured that each terminal has a plurality of stable conductive paths with the chip module, thereby reducing the high-frequency signal transmission capability of the terminals, and thus actual demands cannot be met.

Therefore, a heretofore unaddressed need to design an improved terminal and a manufacturing method thereof exists in the art to address the aforementioned deficiencies and inadequacies.

SUMMARY

In view of the problems in the background, the present invention is directed to a terminal and a manufacturing method thereof, where a distance between two contact portions of the terminal is increased so as to prevent the two contact portions of the same terminal from contacting each other, thereby ensuring that the terminal has a plurality of stable conductive paths to reduce self-inductance, to reduce cross-talk and to meet transmission of a high-frequency signal.

To solve the foregoing problems, the present invention adopts the following technical solutions.

A terminal configured to be electrically connected to a chip module includes: a base; an elastic arm, formed by bending and extending upward from one end of the base, the elastic arm having a through slot, two branches and two contact portions, wherein the through slot penetrates through the elastic arm, the elastic arm forms the two branches on two opposite sides of the through slot, the two branches break from each other at an end of the elastic arm without blanking, each of the two contact portions is formed at an end of one of the two branches, the two contact portions abut a same pad of the chip module, and each of the branches defines a center line along an extending direction thereof; and an extrusion portion, provided on a corresponding one of the two branches, the extrusion portion being located between the two center lines, wherein the extrusion portion is a concave structure formed by a punching equipment applying a force correspondingly onto the branches, such that the branches correspondingly plastically deform, and deformations of each of the branches at two sides of the center line thereof are different from each other, thereby increasing a distance between the two contact portions.

In certain embodiments, the terminal includes two extrusion portions, wherein each of the two branches is provided with one of the two extrusion portions, and the two extrusion portions are symmetrically provided about a center line of the through slot.

In certain embodiments, the extrusion portion is concavely formed on one plate surface of the corresponding one of the branches toward an opposite other plate surface, and the extrusion portion does not penetrate the other plate surface.

In certain embodiments, each of the contact portions has an abutting surface abutting the chip module, and the abutting surface and the extrusion portion are located on a same plate surface of the corresponding one of the branches.

In certain embodiments, the extrusion portion is located on the elastic arm at a location adjacent to the base.

In certain embodiments, the distance between the two contact portions is smaller than a width of the through slot.

In certain embodiments, each of the branches has an inner edge and an outer edge opposite to each other, the inner edge is adjacent to the through slot, and each of the contact portions is formed by flipping upward of the inner edge at the end of each of the branches.

In certain embodiments, an upper surface of each of the contact portions tilts downward to form a chamfer, such that a contact area between each of the contact portions and the chip module is decreased.

In certain embodiments, a bending portion is formed by bending and extending downward from an opposite end of the base, a conducting portion is formed by bending and extending from the bending portion, the conducting portion is configured to be conducted to a circuit board, the terminal has a through hole penetrating through the base and the bending portion, the through hole has an upper edge in the base, each of the branches is provided with one extrusion portion, and a distance between outer edges of the two extrusion portions is smaller than or equal to a length of the upper edge.

In certain embodiments, the distance between the two contact portions is greater than zero and smaller than or equal to 0.12 mm.

Another technical solution includes: a terminal, configured to be electrically connected to a chip module, including: a base; an elastic arm, formed by bending and extending upward from one end of the base, the elastic arm having a through slot, two branches and two contact portions, wherein the through slot penetrates through the elastic arm, the elastic arm forms the two branches on two opposite sides of the through slot, the two branches break from each other at an end of the elastic arm without blanking, each of the two contact portions is formed at an end of one of the two branches, the two contact portions abut a same pad of the chip module, and each of the branches defines a center line along an extending direction thereof; and an extrusion portion, provided between the two center lines, wherein the extrusion portion is a concave structure formed by a punching equipment applying a force onto the terminal, and portions near the extrusion portion plastically deform, such that the two branches move away from each other, thereby increasing a distance between the two contact portions.

A manufacturing method of a terminal includes: S1: providing a metal plate sheet, and punching the metal plate sheet to form a through slot thereon, such that the metal plate sheet forms two branches on two opposite sides of the through slot; S2: cutting one end of each of the two branches, such that the ends of the two branches are separated from each other to form two contact portions respectively, and a first distance is initially provided between the two contact portions; and S3: extruding at least one of the two branches, such that the extruded branch plastically deform to increase the first distance between the two contact portions to become a second distance.

In certain embodiments, in the step S3, prior to extruding the at least one of the two branches, each of the branches is flat plate shaped, and the at least one of the two branches moves on a same plane before and after being extruded.

In certain embodiments, after the step S2, the method includes a step S21: bending one end of each of the branches, such that a cutting section of each of the branches form one of the contact portions.

In certain embodiments, after the step S2, the method includes a step S22: bending each of the two branches, such that each of the branches forms a first arm being vertical and a second arm bending and extending from the first arm, wherein each of the contact portions is formed at an end of the second arm.

In certain embodiments, in the step S3, a punching equipment extrudes one plate surface of a corresponding one of the branches toward an opposite other plate surface to form an extrusion portion, wherein the extrusion portion is a concave portion not penetrating the other plate surface of the corresponding one of the branches.

In certain embodiments, in the step S3, a punching equipment extrudes a plate edge of a corresponding one of the branches adjacent to the through slot to form an extrusion portion, wherein the extrusion portion is concavely formed from the plate edge of the corresponding one of the branches.

In certain embodiments, after the step S3, the method includes a step S31: bending free ends of the two branches away from plate surfaces of the branches, thereby further increasing the second distance between the two contact portions.

In certain embodiments, after the step S3, the method includes a step S32: bending the two branches, such that each of the branches forms a first arm being vertical and a second arm bending and extending from the first arm, wherein each of the contact portions is formed at an end of the second arm.

In certain embodiments, a specific method for extruding the at least one of the branches in the step S3 includes: fixing the branches to a fixed die, and then providing a punch, wherein a force applying block is provided on a lower surface of the punch, and wherein when the punch approaches the fixed die, the force applying block extrudes the at least one of the two branches and forms at least one extrusion portion on the at least one of the two branches, and the at least one extrusion portions is located between center lines of the two branches along an extending direction thereof.

Compared with the related art, the present invention has the following beneficial effects.

At least one extrusion portion is located between the two center lines, such that when the extrusion portion is extruded by the punching equipment, the metal plate sheet expands outward, and at least one of the branches plastically deform, such that the two contact portions move away from each other to increase the distance between the two contact portions, preventing the two contact portions of the terminal from contacting each other and moving altogether in the process where the terminal is pressed by the chip module and elastically deforms, ensuring that the terminal has two stable contact points with the chip module, and guaranteeing the high-frequency performance of the terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
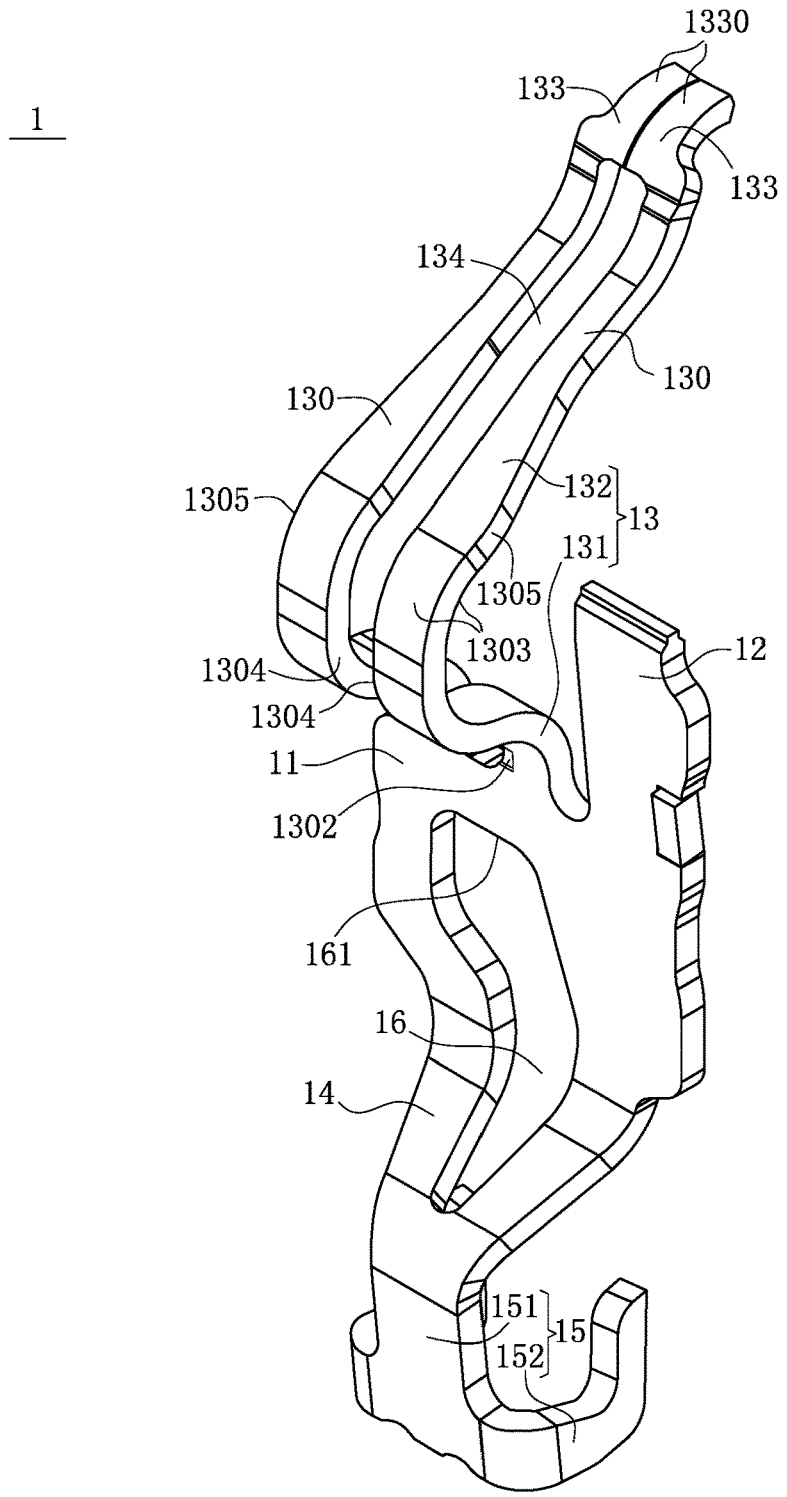
FIG. 1 is a perspective view of a terminal according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to a terminal and a manufacturing method thereof.

Figure 2:
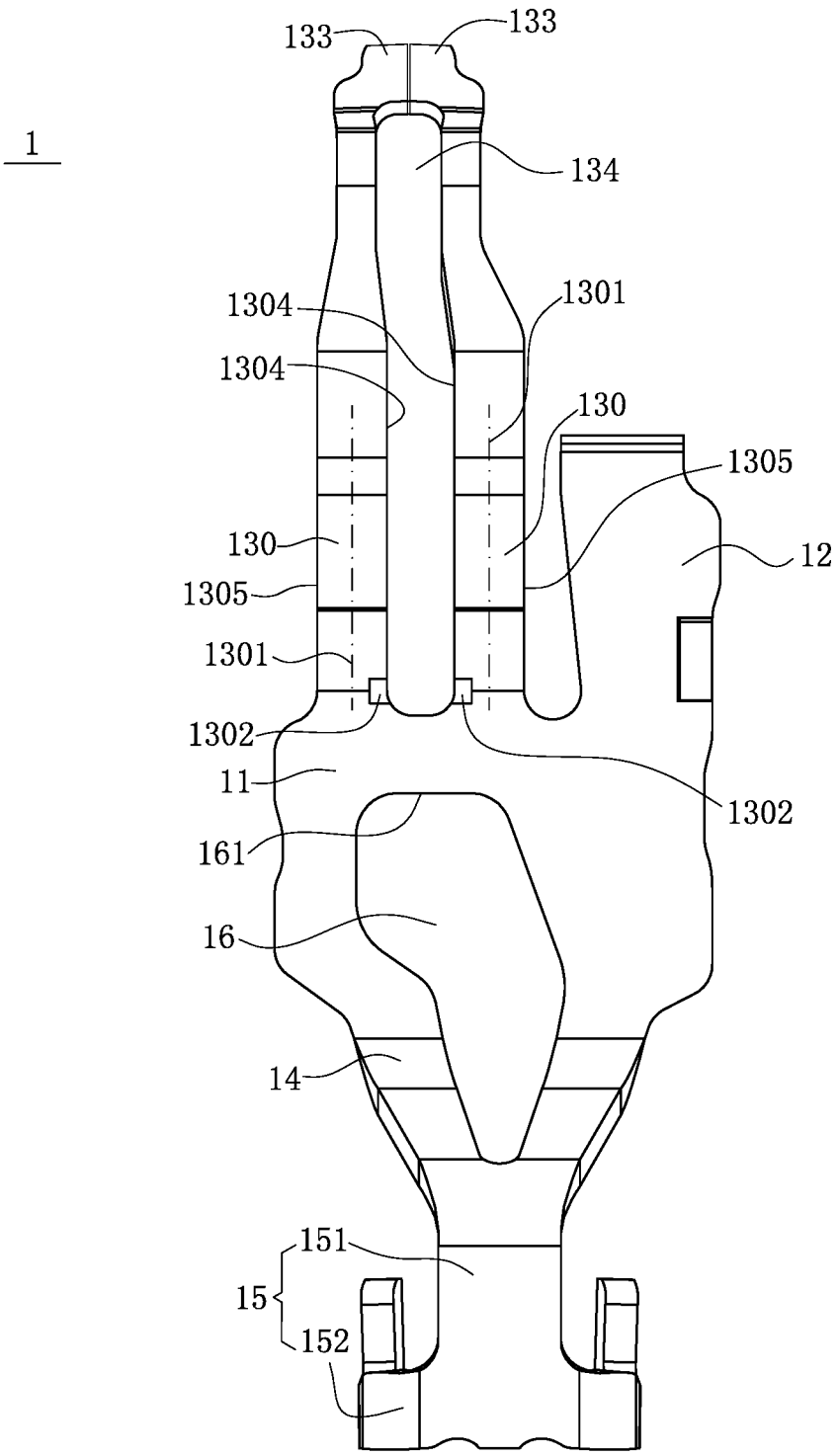
FIG. 2 is a front view of a terminal according to the first embodiment of the present invention.
Figure 3:
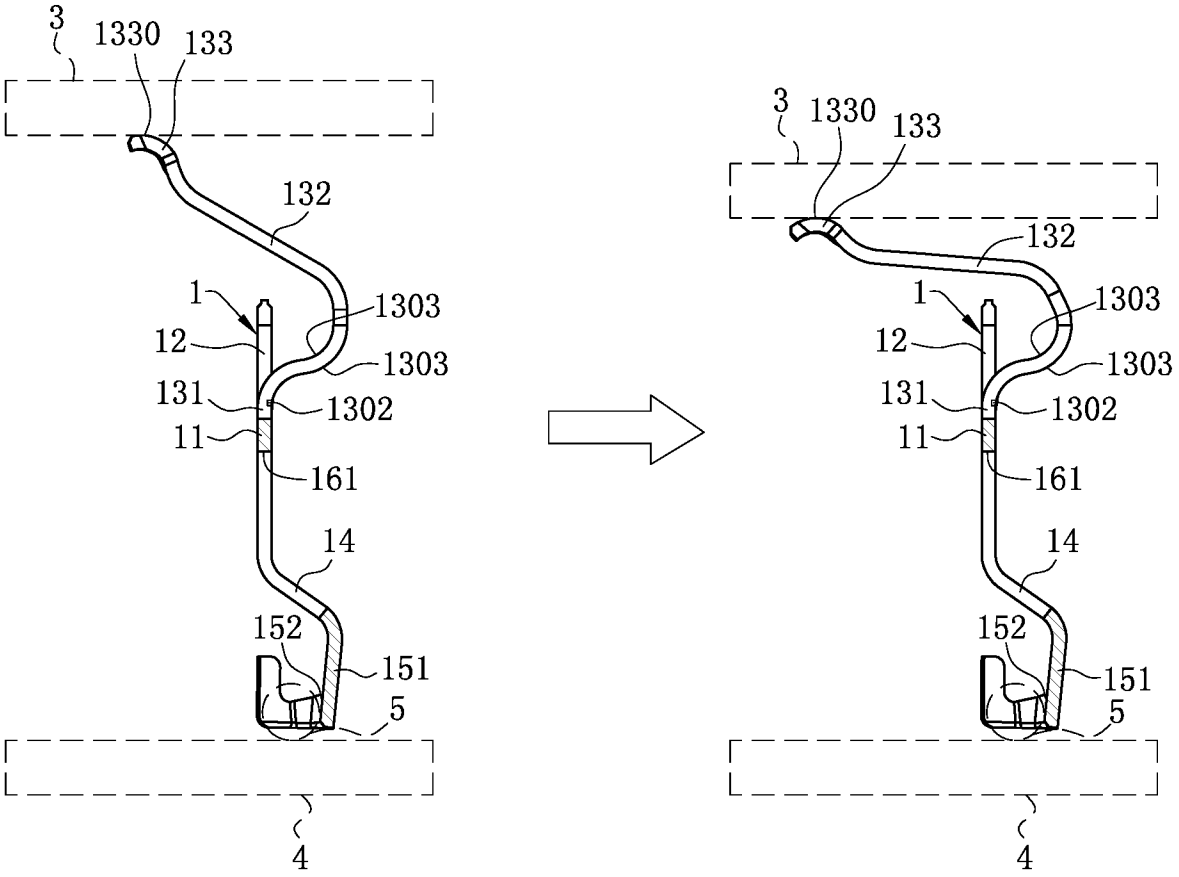
FIG. 3 is a schematic view illustrating a state change of a terminal before and after being pressed by a chip module according to the first embodiment of the present invention.

FIG. 1 to FIG. 3 show a terminal 1 according to a first embodiment of the present invention. The terminal 1 of the embodiment is mounted to an electrical connector (not shown in the figures, similarly hereinafter) and is used for electrically connecting a chip module 3 to a circuit board 4, which includes a base 11, two contact portions 133 located at an upper end of the base 11, and a conducting portion 15 located at a lower end of the base 11. The electrical connector is mounted with a plurality of the terminals 1.

As shown in FIG. 1 and FIG. 3, specifically, the terminal 1 is formed by punching a metal plate sheet. The base 11 has a vertical plane, a strip connecting portion 12 is formed by extending upward vertically from the upper end of the base 11, and an elastic arm 13 is formed by bending and extending upward from the upper end of the base 11. The strip connecting portion 12 is used for connecting a strip (not shown in the figures), and the elastic arm 13 elastically abuts the chip module 3. Further, the elastic arm 13 includes a first arm 131 extending upward vertically from the base 11, and a second arm 132 formed by bending and extending from the first arm 131 away from the vertical plane, and then bending and extending reversely across the vertical plane. The contact portions 133 are formed at the end of the second arm 132 and abut the chip module 3. Such an arrangement increases the elasticity of the elastic arm 13 and ensures a good electrical contact between the terminal 1 and the chip module 3.

As shown in FIG. 1 and FIG. 2, the terminal 1 further has a through slot 134 penetrating through the elastic arm 13 vertically, and the through slot 134 extends upward to the contact portions 133 and extends downward to a connecting location connecting the first arm 131 to the base 11. Thus, a length of the through slot 134 in the elastic arm 13 is increased to the greatest extent, the self-inductance of the elastic arm 13 is reduced, cross-talk between the adjacent terminals 1 is reduced, and the elasticity of the elastic arm 13 is also increased. In other embodiments, the through slot 134 does not extend to the connecting location connecting the first arm 131 to the base 11. As long as the through slot 134 can extend to the first arm 131 along an extending direction of the elastic arm 13, the self-inductance effect of the terminal 1 can be significantly improved.

As shown in FIG. 1 and FIG. 2, the elastic arm 13 forms two branches 130 on two opposite sides of the through slot 134. The two contact portions 133 are formed at ends of the two branches 130 respectively, and the two contact portions 133 break from each other without blanking, such that a gap is provided between the two contact portions 133 and the two contact portions 133 are disconnected. Thus, the terminal 1 has two independent contact areas abutting a same pad of the chip module 3, so as to increase contact points between the terminal 1 and the chip module 3, such that the terminal 1 and the chip module 3 form a plurality of conductive paths, and the high-frequency signal transmission capacity of the terminal 1 is enhanced.

Figure 5:
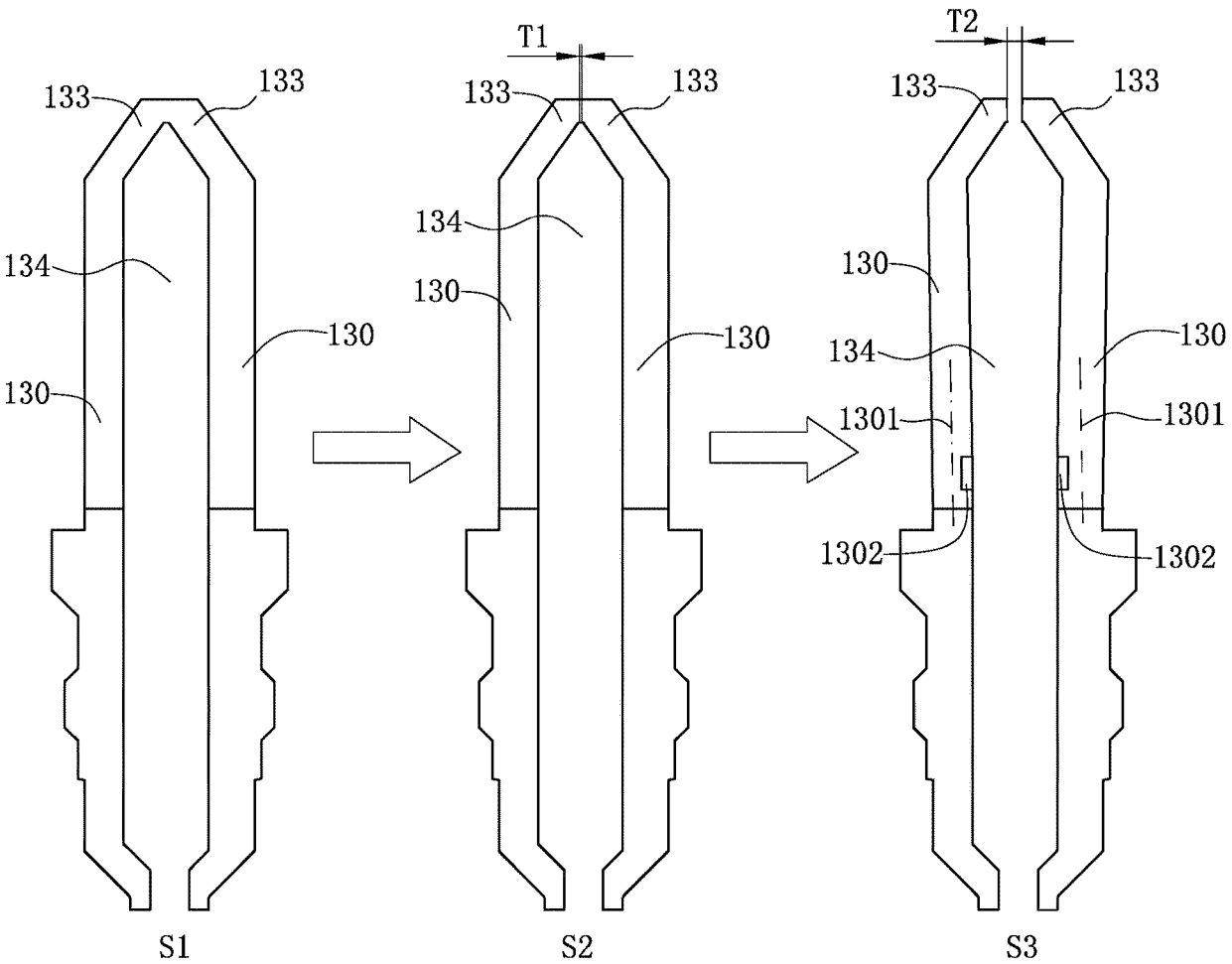
FIG. 5 is a schematic view showing the changes of the terminal in steps S1 to S3 of the manufacturing method of a terminal according to one embodiment of the present invention.

As shown in FIG. 2, FIG. 3 and FIG. 5, each branch 130 defines a center line 1301 along an extending direction thereof. At least one of the branches 130 is provided with an extrusion portion 1302 on its first arm 131. In this embodiment, each of the branches 130 is provided with one extrusion portion 1302 on its first arm 131, and the two extrusion portions 1302 are located between the two center lines 1301. When the two branches 130 are extruded by a punching equipment 2, concave structures are respectively formed as the extrusion portions 1302, and the extrusion portions 1302 make the metal plate sheet expand outward, and the two branches 130 plastically deform away from each other even through the deformations of each of the branches at the two sides of the center lines 1301 are different from each other, such that a distance between the two contact portions 133 can be expanded, thereby preventing the two contact portions 133 from contacting each other and moving altogether in the process where the elastic arm 13 is pressed by the chip module 3 and elastically deforms, ensuring that the terminal 1 has two stable contact points with the chip module 3, and guaranteeing the high-frequency performance of the terminal 1. Further, to balance the plastic deformation amounts of the two branches 130, the two extrusion portions 1302 are symmetrically provided about a center line 1341 of the through slot 134.

Eventually, the distance between the contact portions 133 is smaller than or equal to 0.12 mm, but is greater than zero, thus ensuring that the two contact portions 133 of the terminal 1 contact a same pad of the chip module 3, and reducing a risk of the contact portions 133 sliding out of the pad of the chip module 3.

In another embodiment, only one branch 130 is provided with one extrusion portion 1302. In a further embodiment, the terminal 1 may be provided with one extrusion portion 1302 on the base 11. The extrusion portion 1302 is located between the two center lines 1301, and the extrusion portion 1302 is located right below the through slot 134 and provided adjacent to the through slot 134. The extrusion portion 1302 is a concave structure formed by the punching equipment 2 applying a force onto the base 11, and portions near the extrusion portion 1302 plastically deform, such that the two branches 130 move away from each other, thereby increasing the distance between the two contact portions 133. In the two embodiments as discussed above, the two contact portions 133 can be prevented from contacting each other and moving altogether in the process where the elastic arm 13 is pressed by the chip module 3 and elastically deforms, ensuring that the terminal 1 has two stable contact points with the chip module 3, and guaranteeing the high-frequency performance of the terminal 1.

Each of the branches 130 has two plate surfaces 1303 provided opposite to each other, and two plate edges connecting the two plate surfaces 1303. The two plate edges include an inner edge 1304 and an outer edge 1305, and the inner edge 1304 is provided to be adjacent to the through slot 134. Each extrusion portion 1302 is concavely formed on one of the plate surfaces 1303 of the corresponding branch 130 toward the other plate surface 1303, and does not penetrate through the other plate surface 1303. Each of the extrusion portions 1302 is adjacent to the through slot 134. Each contact portion 133 is provided with an abutting surface 1330 for abutting the chip module 3. The abutting surface 1330 and a corresponding extrusion portion 1302 are located on a same plate surface of each of the branches 130, such that it is convenient for the punching equipment 2 to apply a force thereon, so as to reduce the molding difficulty of the terminal 1. In addition, a distance between the two contact portions 133 is much smaller than a width of the through slot 134. That is, the distance between the two contact portions 133 is not greater than the half width of the through slot 134, thereby ensuring that the two contact portions 133 of the same terminal 1 can abut the same pad of the chip module 3 at the same time, and avoiding short circuiting of the chip module 3 due to one terminal 1 abutting two adjacent pads of the chip module 3. In this embodiment, each of the extrusion portions 1302 is located at a location of the first arm 131 adjacent to the base 11. In other embodiments, the extrusion portions 1302 may be located at any other locations, as long as they are located between the two center lines 1301 of the two branches 130. When the punching equipment extrudes the extrusion portions 1302, the branches 130 are plastically deformed, so as to increase the distance between the two contact portions 133.

The width of the through slot 134 is greater than a thickness of the terminal 1 and smaller than a width of each branch 130, thus avoiding the weak strength of the terminal 1 caused by an excessively large width of the through slot 134, and avoiding the minimized influence of the through slot 134 on the self-inductance effect of the terminal 1 caused by an excessively small width of the through slot 134, thereby achieving a balance in the structural strength and functional demand of the terminal 1. Preferably, in this embodiment, the thickness of the terminal 1 is 0.08 mm.

As shown in FIG. 1 to FIG. 3, the terminal 1 has a bending portion 14 formed by bending from the base 11 and extending downward, and a conducting portion 15 formed by bending and extending from the bending portion 14. The conducting portion 15 is used for conducting the circuit board 4. Specifically, the conducting portion 15 includes a connecting portion 151 formed by bending and extending downward from the bending portion 14, and two clamping portions 152 formed by bending and extending from two opposite sides of the connecting portion 151. The two clamping portions 152 co-clamp a solder 5, and the conducting portion 15 is soldered to the circuit board 4 via the solder 5. The bending portion 14 and the connecting portion 151 are located on the same side of the base 11, and extending along a downward direction, a width of the bending portion 14 is reduced gradually, thereby increasing the elasticity of the bending portion 14.

The terminal 1 further has a through hole 16 penetrating through the base 11, and the through hole 16 extends from the base 11 to the bending portion 14, but does not extend to the conducting portion 15. That is, the through hole 16 penetrates through the base 11 and the bending portion 14 and does not penetrate through the conducting portion 15. Thus, the self-inductance effect of the terminal 1 can be further reduced. Moreover, it is also ensured that the conducting portion 15 is strong enough. The through hole 16 has an upper edge 161 in the base 11, and a distance between outer edges of the two extrusion portions 1302 is smaller than or equal to a length of the upper edge 161, thereby avoiding excessively small plastic deformation of the terminal 1 extruded by the punching equipment 2 due to an excessively long distance between the two extrusion portions 1302.

As shown in FIG. 2 and FIG. 3, when the terminal 1 is soldered to the circuit board 4 and the chip module 3 is stably pressed down, the terminal 1 can form four conductive paths, namely two conductive paths being in parallel with each other from two opposite sides of the through slot 134 and the through hole 16 downward from the top, and two crossed conductive paths from the left side of the through slot 134 to the right side of the through hole 16 and from the right side of the through slot 134 to the left side of the through hole 16. By means of the four conductive paths, the high-frequency signal transmission capability of the terminal 1 is improved.

Figure 4:
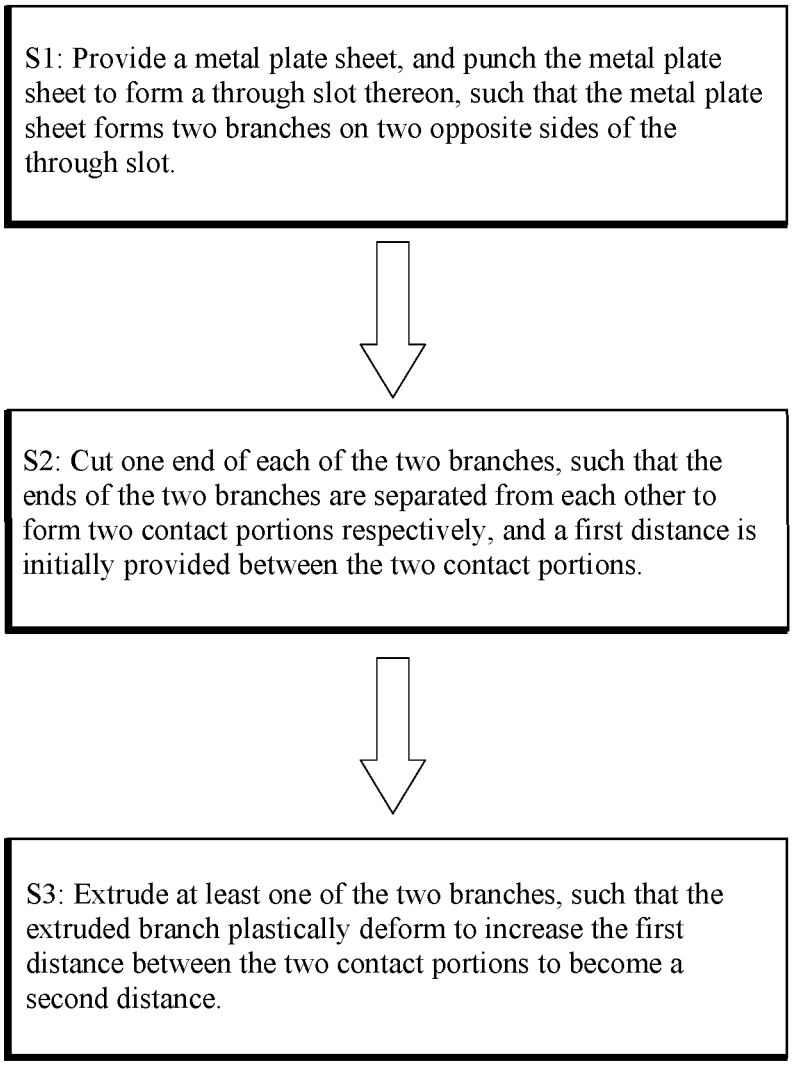
FIG. 4 is a flowchart showing steps S1 to S3 of a manufacturing method of a terminal according to one embodiment of the present invention.

As shown in FIG. 4 and FIG. 5, a manufacturing method of the terminal 1 of the present invention includes: S1: providing a metal plate sheet, and punching the metal plate sheet to form the through slot 134 thereon, such that the metal plate sheet forms the two branches 130 on two opposite sides of the through slot 134. S2: cutting one end of each of the two branches 130, such that the ends of the two branches 130 are separated from each other to form the two contact portions 133 respectively, and a first distance T1 is initially provided between the two contact portions 133. It should be noted that, when the connecting ends of the two branches 130 are cut and separated, plate surfaces of the connecting ends of the two branches 130 are stressed in opposite directions, and when the two branches are separated, the metal plate sheet material is not reduced due to the cutting action. That is, the two contact portions 133 break from each other without blanking. In other words, the first distance T1 is zero. S3: extruding the two branches 130, such that the two branches 130 plastically deform away from each other to increase the first distance T1 between the two contact portions 133 to become a second distance T2. That is, the distance between the two contact portions 133 is increased, thus making the two contact portions 133 out of contact.

Figure 6:
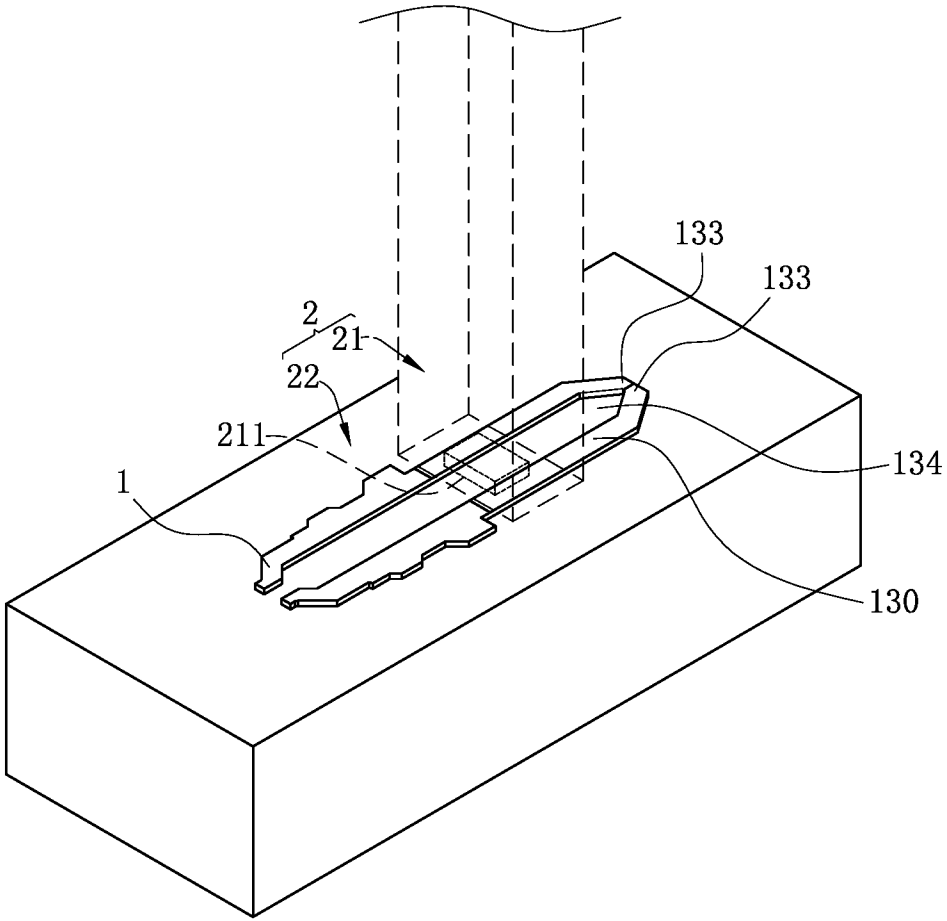
FIG. 6 is a schematic view of a punching equipment in operation during execution of step S3 of the manufacturing method of a terminal according to one embodiment of the present invention.

Specifically, as shown in FIG. 6, in step S3, the punching equipment 2 includes a punch 21 and a fixed die 22. The branches 130 are fixed to the fixed die 22, and a force applying block 211 is provided on a lower surface of the punch 21. When the punch 21 approaches the fixed die 22, the force applying block 211 extrudes one plate surface 1303 of each of the branches 130 toward the other plate surface 1303, and forms an extrusion portion 1302 on each branch 130. Each extrusion portion 1302 is a concave structure and does not penetrate the other plate surface 1303 of the corresponding branch 130, and the two extrusion portions 1302 are located between the center lines 1301 of the two branches 130. Thus, after the extrusion portions 1302 are stressed, the metal plate sheet expands outward, and the two branches 130 plastically deform away from each other to increase the distance between the two contact portions 133, thus preventing the two contact portions 133 from contacting each other during elastic deformation of the terminal 1 pressed by the chip module 3, and ensuring that the terminal 1 can have two independent contact points with the same conductive pad of the chip module 3, such that the terminal 1 and the chip module 3 form a plurality of stable conductive paths, and the high-frequency signal transmission capability of the terminal 1 is enhanced.

It should be noted that, in this embodiment, prior to extruding the branches 130, each of the branches 130 is flat plate shaped, and the branches 130 move on a same plane before and after being extruded. Then, each branch 130 is performed with plate surface bending to form the contact portion 133, the first arm 131 and the second arm 132. In other embodiments, the punch equipment 2 may extrude only one of the branches 130 such that the extruded branch 130 is plastically deformed, which may satisfy the requirement to increase the distance between the two contact portions 133, preventing the two contact portions 133 from contacting each other during elastic deformation of the terminal 1 pressed by the chip module 3.

Figure 7:
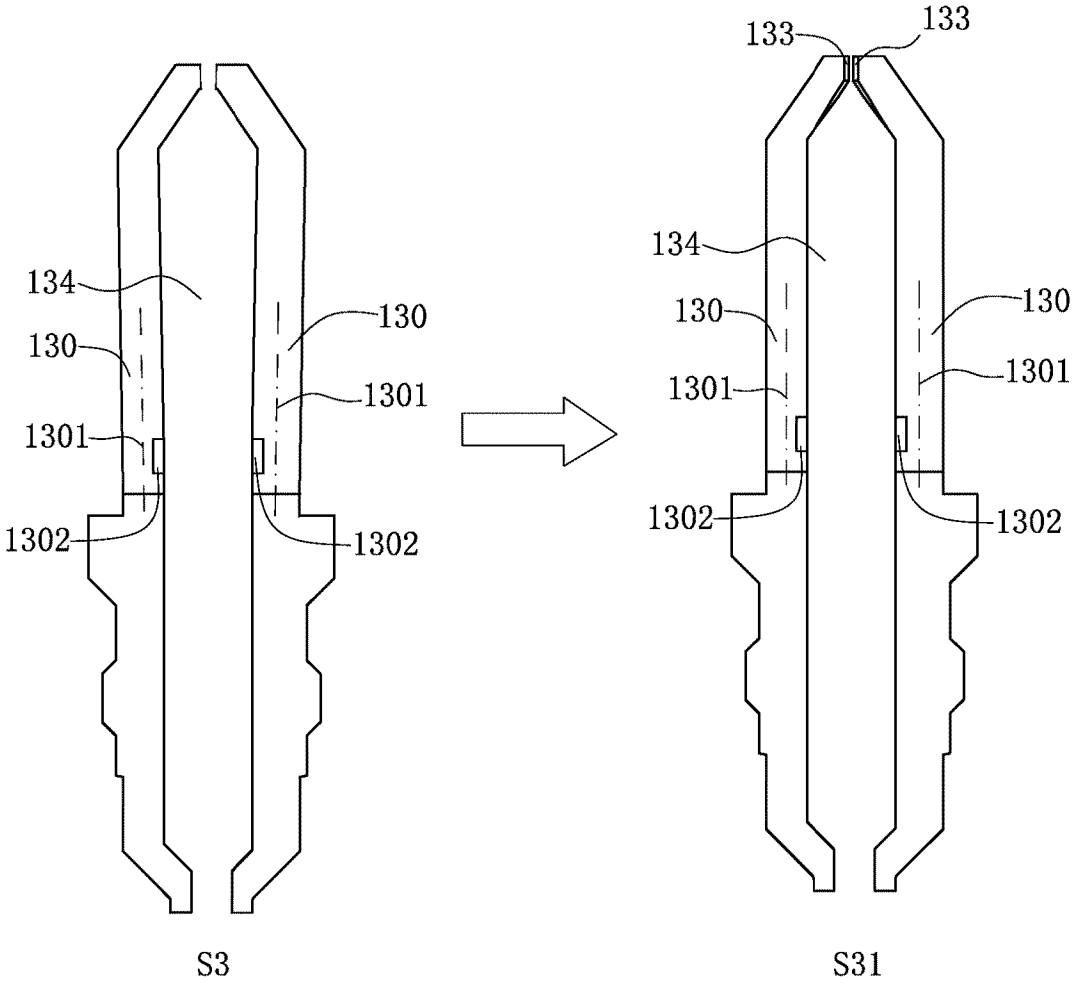
FIG. 7 is a schematic view showing the changes of the terminal in steps S3 to S31 of the manufacturing method of a terminal according to one embodiment of the present invention.
Figure 8:
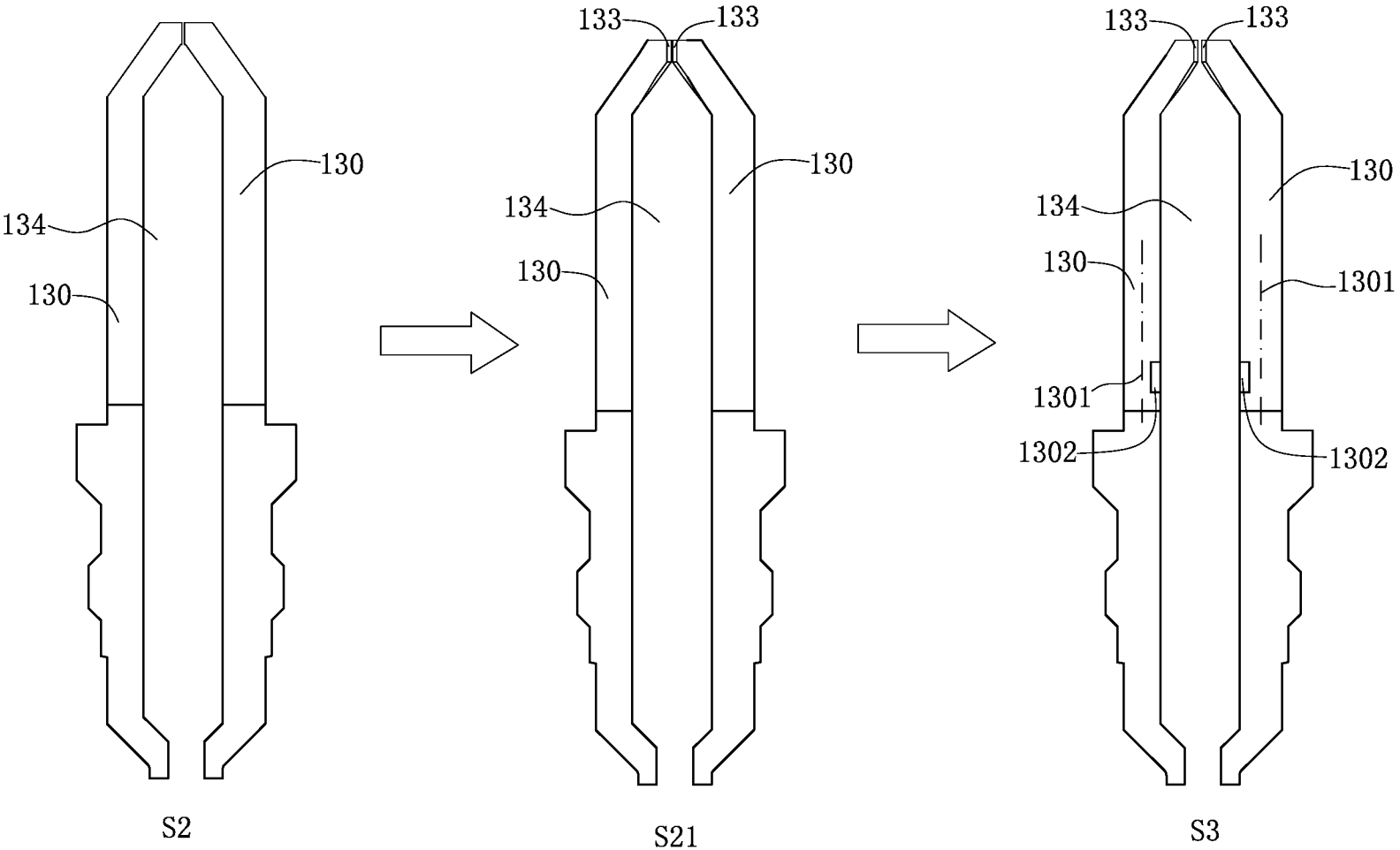
FIG. 8 is a schematic view showing the changes of the terminal in steps S2 to S21 to S3 of the manufacturing method of a terminal according to one embodiment of the present invention.

It should be particularly noted that, as shown in FIG. 7, after step S3, it is optional to perform a step S31: bending an end of each of the branches 130. That is, the inner edge 1304 at the end of each of the branches 130 is flipped outward, such that cutting sections of the branches 130 form the contact portions 133, thereby reducing the contact area between the contact portions 133 and the chip module 3, and facilitating dense arrangement of pads on the chip module 3. Alternatively, after step S3, it is optional to perform a step S32: bending the two branches 130, such that the branches 130 form a first arm 131 being vertical and a second arm 132 bending and extending from the first arm 131, where each of the contact portions 133 are formed at an end of the second arm 132, so as to form the terminal 1 in the first embodiment. As shown in FIG. 8, in another method, the step S31 or the step S32 may be performed before step S3 is completed and after step S2 is completed, thus becoming a step S21 or a step S22. Specifically, the action of the step S21 is identical to that of the step S31, and the action of the step S22 is identical to that of the step S32, and the details of these steps are not elaborated herein.

Figure 9:
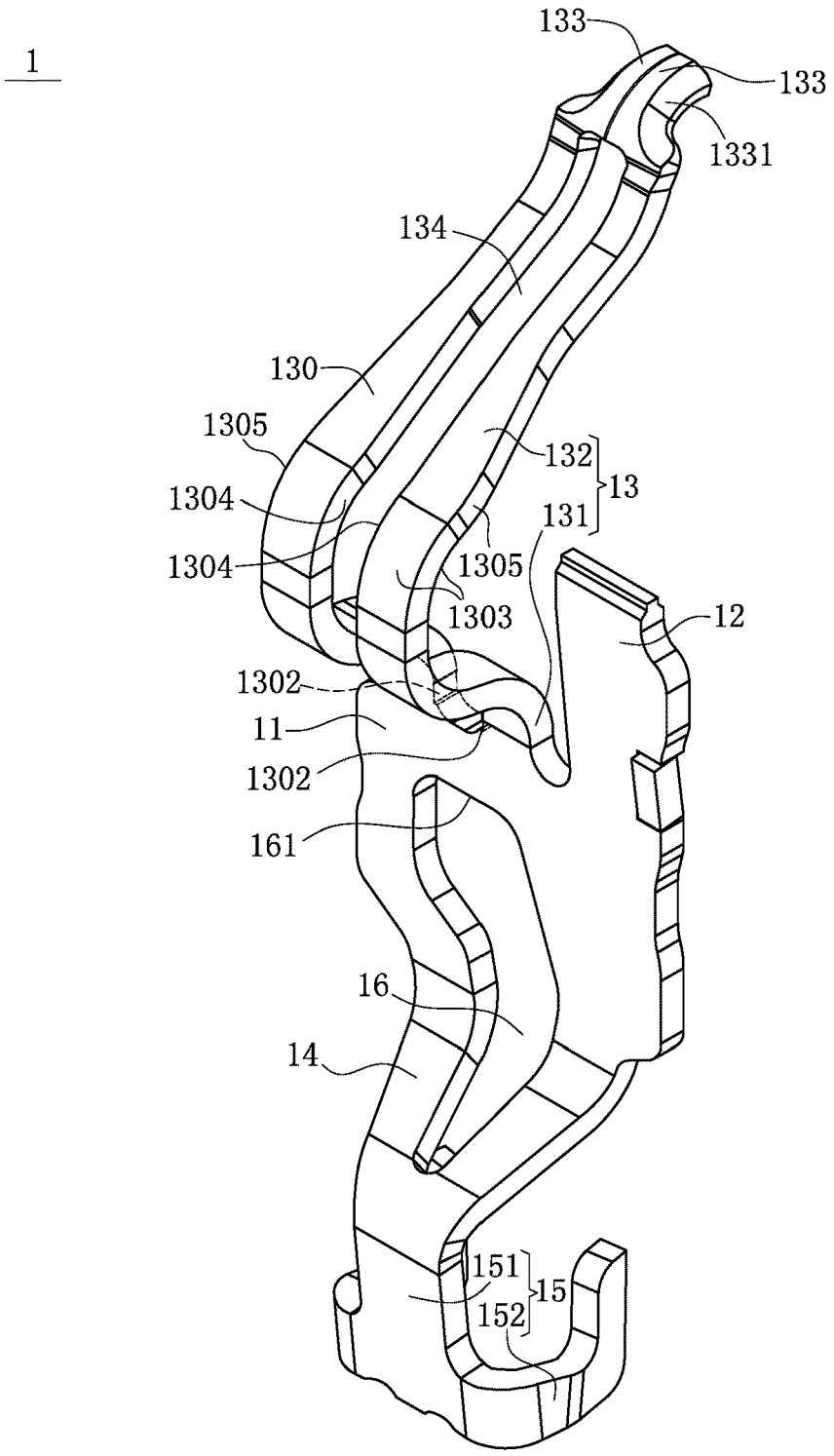
FIG. 9 is a perspective view of a terminal according to a second embodiment of the present invention.
Figure 10:
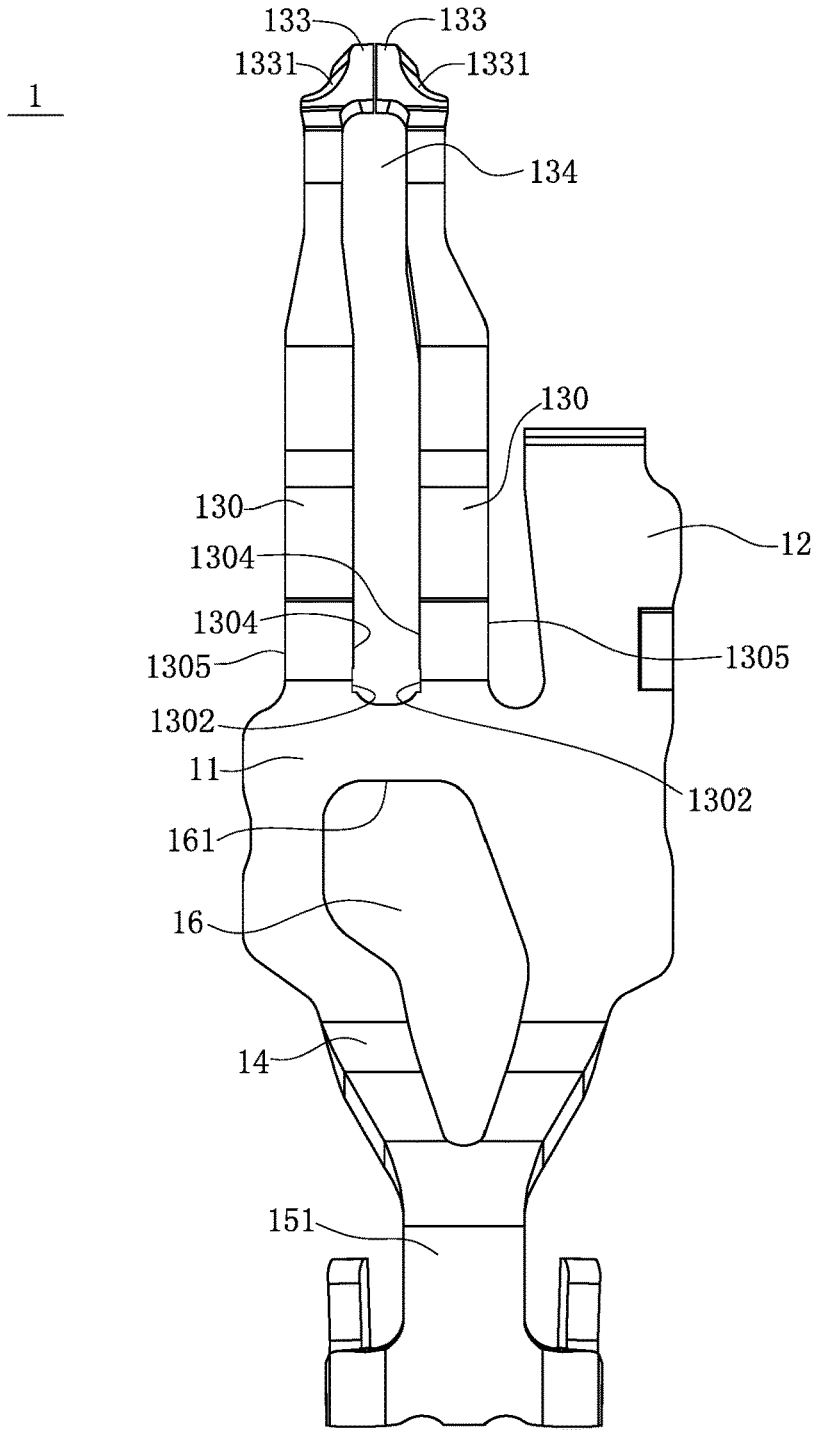
FIG. 10 is a front view of a terminal according to the second embodiment of the present invention.

FIG. 9 and FIG. 10 show the terminal 1 according to a second embodiment of the present invention. The difference between this embodiment and the first embodiment lies in that an upper surface of each contact portion 133 tilts downward to form a chamfer 1331, such that a contact area between each of the contact portions 133 and the pad of the chip module 3 is reduced, reducing a risk of the contact portions 133 sliding out of the pad of the chip module 3. Each extrusion portion 1302 is concavely formed on the inner edge 1304 of the corresponding branch 130. Other structures and functions of this embodiment are identical to those of the first embodiment, and are not elaborated herein.

To sum up, the terminal and the manufacturing method thereof according to certain embodiments of the present invention has the following beneficial effects.

(1) At least one extrusion portion 1302 is provided on at least one of the branches 130, and each extrusion portion 1302 is located between the two center lines 1301. When each extrusion portion 1302 is extruded by the punching equipment 2, the metal plate sheet expands outward, and at least one of the branches 130 plastically deform, such that the distance between the two contact portions 133 can be expanded, thereby preventing the two contact portions 133 from contacting each other and moving altogether in the process where the elastic arm 13 is pressed by the chip module 3 and elastically deforms, ensuring that the terminal 1 has two stable contact points with the chip module 3, and guaranteeing the high-frequency performance of the terminal 1.

(2) The through slot 134 penetrates through the elastic arm 13, and the through hole 16 penetrates through the base 11 and the connecting portion 151, such that the terminal 1 forms four conductive paths, namely two conductive paths being in parallel with each other from two opposite sides of the through slot 134 and the through hole 16 downward from the top, and two crossed conductive paths from the left side of the through slot 134 to the right side of the through hole 16 and from the right side of the through slot 134 to the left side of the through hole 16. By means of the four conductive paths, the high-frequency signal transmission capability of the terminal 1 is improved.

(3) The ends of the branches 130 bend, such that cutting sections of the branches 130 form the contact portions 133, thereby reducing the contact area between the contact portions 133 and the chip module 3, and facilitating dense arrangement of pads on the chip module 3.

(4) The through hole 16 has an upper edge 161 in the base 11, and a distance between outer edges of the two extrusion points 1302 is smaller than or equal to a length of the upper edge 161, thereby avoiding an excessively long distance between the two extrusion points 1302, and avoiding excessively small plastic deformation of the terminal 1 extruded by the punching equipment 2.

(5) The upper surface of each contact portion 133 tilts downward to form a chamfer 1331, such that a contact area between each of the contact portions 133 and the pad of the chip module 3 is reduced, reducing a risk of the contact portions 133 sliding out of the pad of the chip module 3.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A terminal, configured to be electrically connected to a chip module, comprising:

a base;

an elastic arm, formed by bending and extending upward from one end of the base, the elastic arm having a through slot, two branches and two contact portions, wherein the through slot penetrates through the elastic arm, the elastic arm forms the two branches on two opposite sides of the through slot, each of the two contact portions is formed at an end of one of the two branches, the two contact portions abut a same pad of the chip module, and each of the branches defines a center line along an extending direction thereof;

a bending portion, formed by bending and extending downward from an opposite end of the base, wherein a through hole penetrates through the base and the bending portion, and the through hole has an upper edge in the base;

a conducting portion, formed by bending and extending from the bending portion, wherein the conducting portion is configured to be conducted to a circuit board; and two extrusion portions, respectively provided on the two branches, wherein each of the two branches is provided with one of the two extrusion portions, a distance between outer edges of the two extrusion portions is smaller than or equal to a length of the upper edge of the through hole, each of the extrusion portions is located between the two center lines, each of the extrusion portions is a concave structure formed by a punching equipment applying a force correspondingly onto the branches, such that the branches correspondingly plastically deform, and deformations of each of the branches at two sides of the center line thereof are different from each other, thereby increasing a distance between the two contact portions.

2. The terminal of claim 1, wherein the two extrusion portions are symmetrically provided about a center line of the through slot.

3. The terminal of claim 1, wherein each of the two branches has two plate surfaces provided opposite to each other and an inner edge and an outer edge connecting the two plate surfaces, the through slot is formed between the inner edges of the two branches, each of the extrusion portions is concavely formed on one of the two plate surfaces of the corresponding one of the branches toward the other one of the two plate surfaces, and each of the extrusion portions does not penetrate the other one of the two plate surfaces.

4. The terminal of claim 3, wherein each of the contact portions has an abutting surface abutting the chip module, and the abutting surface and each of the extrusion portions are located on a same plate surface of the corresponding one of the branches.

5. The terminal of claim 1, wherein each of the extrusion portions is located on the elastic arm at a location adjacent to the base.

6. The terminal of claim 1, wherein the distance between the two contact portions is smaller than a width of the through slot.

7. The terminal of claim 1, wherein each of the branches has an inner edge and an outer edge opposite to each other, the inner edge is adjacent to the through slot, and each of the contact portions is formed by flipping upward of the inner edge at the end of each of the branches.

8. The terminal of claim 1, wherein an upper surface of each of the contact portions tilts downward to form a chamfer, such that a contact area between each of the contact portions and the chip module is decreased.

9. The terminal of claim 1, wherein the distance between the two contact portions is greater than zero and smaller than or equal to 0.12 mm.

10. The terminal of claim 1, wherein the two branches break from each other at an end of the elastic arm without blanking.

* * * * *